US006464090B1

(12) United States Patent
Martinez

(10) Patent No.: US 6,464,090 B1
(45) Date of Patent: Oct. 15, 2002

(54) GOLF CLUB CADDY

(76) Inventor: Robert Martinez, P.O. Box 66, McCordsville, IN (US) 46055

( * ) Notice: Subject to any disclaimer, the term of this patent is extended or adjusted under 35 U.S.C. 154(b) by 0 days.

(21) Appl. No.: 09/993,107

(22) Filed: Nov. 6, 2001

(51) Int. Cl.[7] ..... A47F 7/00

(52) U.S. Cl. ..... 211/70.2; 211/206; 211/182; D6/552; 248/156

(58) Field of Search ..... 211/70.2, 204, 211/206, 189, 182; 248/156; D6/552

(56) References Cited

U.S. PATENT DOCUMENTS

| | | | | | |
|---|---|---|---|---|---|
| 2,051,251 | A | | 8/1936 | Epstein | 16/38 |
| 2,433,617 | A | | 12/1947 | Marsilius | 164/118 |
| 2,737,990 | A | | 3/1956 | De Marco | 150/1.5 |
| 2,987,109 | A | | 6/1961 | Sohmer | 155/2 |
| 2,990,865 | A | | 7/1961 | Steele | 150/1.5 |
| 3,058,504 | A | | 10/1962 | Powers | 150/1.5 |
| 3,215,181 | A | | 11/1965 | Reed | 150/1.5 |
| 3,483,996 | A | * | 12/1969 | Scammon | |
| 3,865,095 | A | | 2/1975 | Helmick | 124/24 R |
| 3,945,743 | A | * | 3/1976 | Koch | |
| 3,971,186 | A | | 7/1976 | Havelka et al. | 52/753 G |
| 4,480,287 | A | | 10/1984 | Jensen | 361/388 |
| 4,824,303 | A | | 4/1989 | Dinger | 411/79 |
| 5,226,666 | A | | 7/1993 | Dinkens, Jr. | 280/652 |
| D346,081 | S | | 4/1994 | Turner | D6/465 |
| D360,248 | S | | 7/1995 | Wright | D21/234 |
| D372,141 | S | | 7/1996 | Selby | D6/465 |
| D372,142 | S | | 7/1996 | Selby | D6/468 |
| D372,144 | S | | 7/1996 | Selby | D6/468 |
| 5,549,208 | A | * | 8/1996 | Yurga | 211/207 |
| 5,775,831 | A | | 7/1998 | Mullenberg | 403/337 |
| 5,873,471 | A | | 2/1999 | Ruggeri | 211/70.2 |
| D407,774 | S | | 4/1999 | Weiss | 321/796 |
| 6,099,199 | A | | 8/2000 | Mullenberg | 403/370 |
| 6,203,239 | B1 | * | 3/2001 | Mussiacciavo et al. | |
| D447,530 | S | | 9/2001 | Hidalgo | D21/796 |
| D457,370 | S | * | 5/2002 | Martinez | D6/552 |

* cited by examiner

*Primary Examiner*—Robert W. Gibson, Jr.
(74) *Attorney, Agent, or Firm*—Brinks Hofer Gilson & Lione

(57) ABSTRACT

A golf club caddy has a pair of standards, each of the standards having a ground supporting member projecting from a lower end. A plurality of U-shaped engagement members are fixed to opposite faces of each standard for receiving the shaft of a golf club. Spacing members are positioned between the pair of standards with a grip portion being centrally located between the ends of an uppermost spacing member for providing a comfortable grip for carrying the caddy. Releasable coupling members extend into the spacing members from each standard. Each of the coupling members includes a proximal and a distal wedge member received into the ends of the spacing members and having outer surfaces sized to engage an inner surface of the spacing members. A threaded member extends through the wedge members so that the proximal wedge is slidably arranged on the threaded member while the distal wedge member is engaged by the threaded member. A handle is connected to each threaded member so that rotation of the handle member causes displacement of the distal wedge member with respect to the spacing member for manual release of the coupling member whereby the standards and spacing members can be quickly and easily disassembled for storage as well as reassembled subsequent to storage.

20 Claims, 5 Drawing Sheets

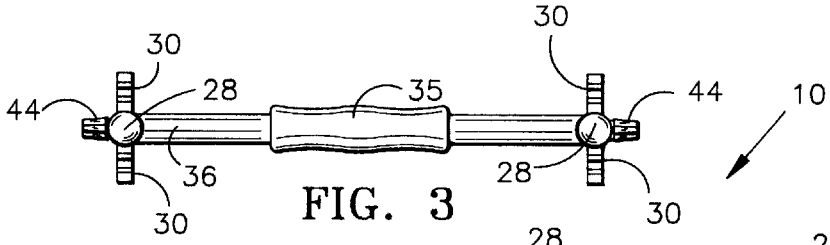
FIG. 3
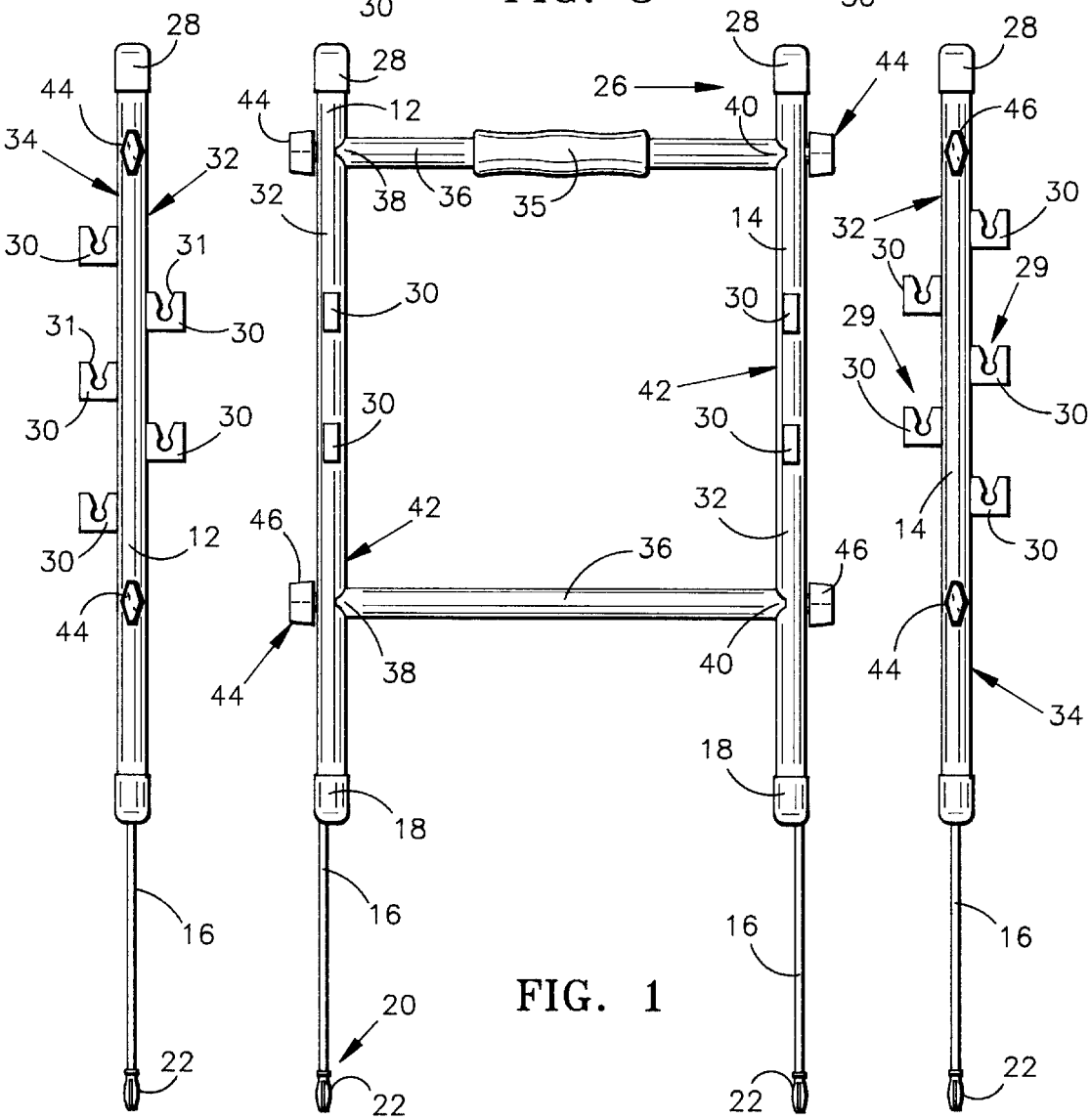
FIG. 1
FIG. 4
FIG. 5
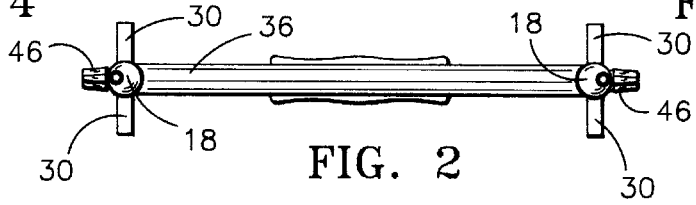
FIG. 2

GOLF CLUB CADDY

BACKGROUND OF THE INVENTION

The present invention is directed generally to non-bag carriers for sporting goods that include elongated shafts, and more particularly to non-bag carriers of golf clubs.

Traditionally, golfers have golfed on full courses that generally require a large variety of different clubs. Each club is used to hit a golf ball a different distance. Generally, these clubs were carried in a golf bag adapted to be slung over the shoulder. Golf bags are usually heavy, cumbersome, and expensive because of the amount and kinds of material required in their fabrication. Sometimes a caddy can be hired to carry the club bag, but are often unavailable or expensive.

Many golfers, because of physical considerations such as age, or time constraints prefer short courses. These courses require less time, less walking and do not require the same number of clubs as a full course. Even less walking is required at a golf range, where often golfers desire to merely hone their skills on just a few clubs at a time. Under any of these circumstances, the conventional golf bag is considered by many an undo encumbrance and burden. As a result several alternatives to the traditional golf bag have been developed.

Several general styles of non-bag carriers are known that are suitable for carrying a modest collection of golf clubs. One style generally has a frame with plurality of legs at a fixed spacing from each other, which enables the carrier to stand freely on the ground similar to a table. Examples of such carriers are disclosed in U.S. Pat. No. 2,990,865 Such carriers are often awkward to carry. Another style of non-bag carrier generally employs a frame with a plurality of legs that are movable with respect to each other from a spread position to a more compact position. Examples of such carriers are disclosed in U.S. Patents Nos. 5,226,666; and 2,987,109. Another style of non-bag golf club carriers includes a frame that has one or more pointed barbs at the bottom which stick into the ground to hold the carrier upright. Examples of such carriers are disclosed in U.S. Patents Nos. 3,215,181; 3,058,504; and 2,737,990. Most of the forgoing carriers are suitable for the intended purpose, are light weight, and hold an adequate number of clubs, without necessarily being suitable for carrying a whole set, which would usually be found in a full sized bag.

All of the forgoing non-bag carriers have the common disadvantage of including a frame of substantially fixed dimension. As a result, the forgoing non-bag carriers tend to take up a lot of space even when not in use. It is therefore a primary aim of the present invention to provide a non-bag carrier for golf clubs that can be quickly broken down without the aid of any tools to occupy a very small volume, yet can be quickly and easily reassembled for use, again without any need for any tools. Another aim of the present invention is a structure that can be quickly assembled by even low skill level laborers so that the manufacturing cost can be minimized.

SUMMARY OF THE INVENTION

A golf club caddy of the present invention generally comprises a pair of standards with a ground-supporting member fixed to a lower end of each standard. A plurality of U-shaped engagement members are fixed to first and second opposite faces of each standard to receive the shaft of at least an abbreviated set of clubs. A set of spacing members are positioned between the pair of standards, each spacing member having ends contacting an inner surface of the standards. Releasable coupling members extend into the spacing member ends from each standard. A handle is connected to each releasable coupling member to facilitate manual release of the coupling member so that the standards and spacing members can be quickly disassembled for storage as well as reassembled subsequent to storage.

In a preferred embodiment, each of the coupling members of the present invention includes a proximal wedge member and a distal wedge member. Both wedge members are received into the ends of the spacing members and have an outer surface sized to engage an inner surface of the spacing members. Each coupling member also includes a threaded member fixed to the handle of the releasable coupling member that extends through both wedge members. Each wedge member includes a tapered edge, with the tapered edges of the two wedge members of each coupling member being slidably engaged with each other. The proximal wedge is preferably slidably arranged with respect to the threaded member while the distal wedge member is engaged by the threaded member so that rotation of the handle member causes displacement of the distal wedge member with respect to the spacing member.

In a further preferred embodiment of the present invention, each of the pair of standards is formed by a tubular member including a block positioned in the lower end of the tubular member. Each block includes a side face spaced from an interior surface of the tubular member forming the standard. Each ground supporting member comprises an elongated stake having a sharpened lower end for penetrating the ground and an upper end having a threaded portion engaged in the block. Preferably, the upper end of each stake includes a smooth face adapting the elongated stake to be slidably received between the side face of the block and the interior surface of the tubular member prior to engagement by rotation of the stake relative to the standard.

An interesting feature of a golf club caddy of the present invention is the use of U-shaped engagement members that comprises a flexible gripping member formed of adhered reclaimed rubber having one side bonded to the standard, the gripping member including an inverted keyhole shaped slot with a tapered opening portion to the slot. The use of such reclaimed rubber engagement members is not only resource friendly, but had the advantage of being able to firmly grip the club shaft without any danger of damaging the club shaft.

Another interesting feature of a golf club caddy of the present invention is the incorporation of a grip portion centrally located between the ends of one of the spacing members for providing a comfortable and balanced grip for carrying the caddy. Another of the spacing members can have a ball and tee pouch slidably received thereon to provide suitable storage for related equipment. Other additions can be conveniently suspended from any of spacing members as desired, and easily removed or omitted from any subsequent re-assembly of the caddy. This feature has the advantage of allowing the user to configure the assembled caddy to fit the particular needs of the individual golfer.

Still other features and advantages of the present invention will become apparent to those skilled in the art upon consideration of the following discussion of a preferred embodiment illustrated in the accompanying Figures showing the best mode of carrying out the invention.

BRIEF DESCRIPTION OF THE DRAWINGS

FIG. 1 back elevation view of a golf club caddy of the present invention.

FIG. 2 is a bottom plan view of the golf club caddy shown in FIG. 1.

FIG. 3 is a top plan view of the golf club caddy shown in FIG. 1.

FIG. 4 is a side elevation view of the golf club caddy from the left side of FIG. 1.

FIG. 5 is a side elevation view of the golf club caddy from the right side of FIG. 1.

DESCRIPTION OF PREFERRED EMBODIMENT

Figure 6:
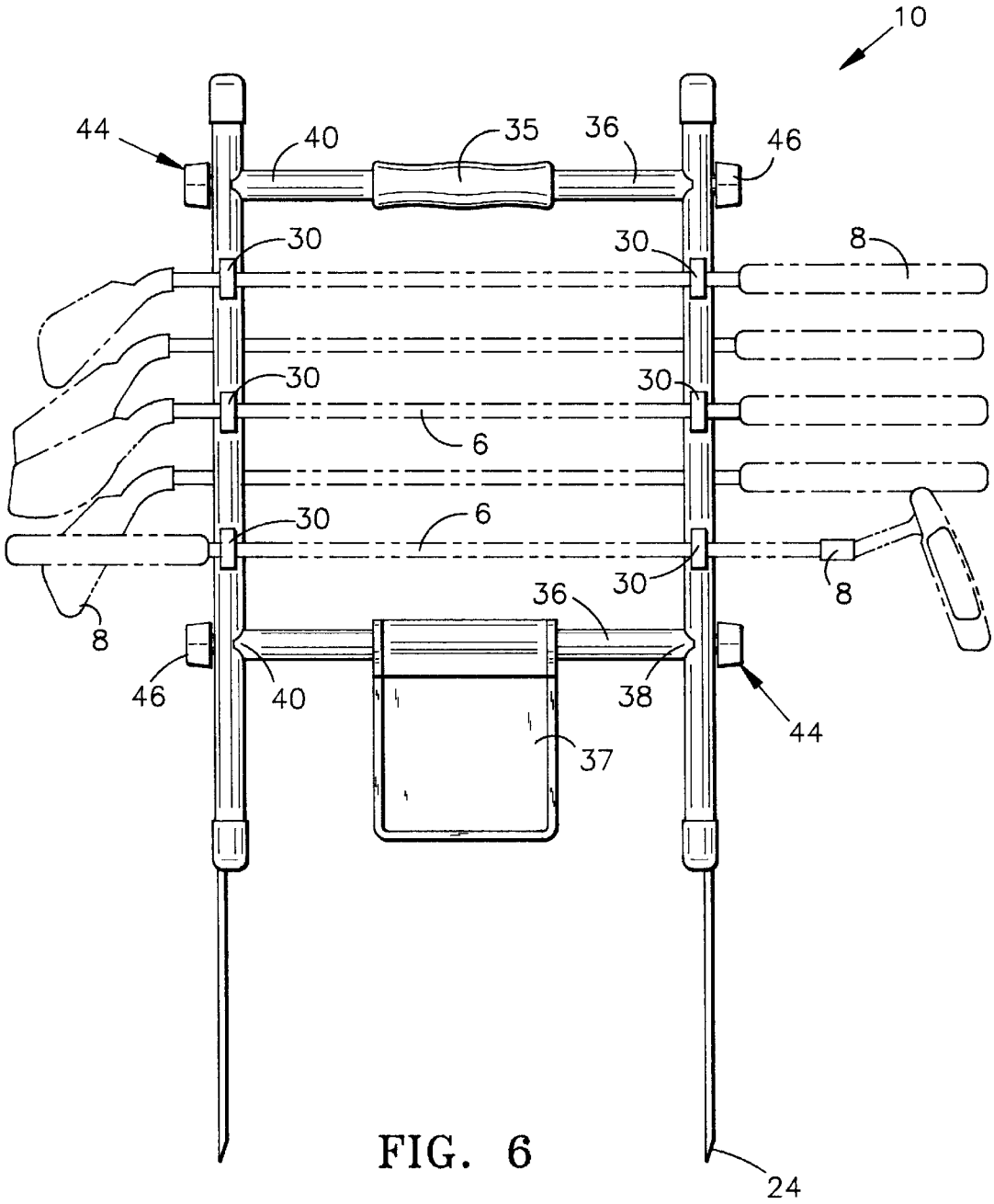
FIG. 6 is a front elevation view of the golf club caddy shown in FIG. 1 with a plurality of golf clubs shown in phantom, and a ball and tee holder suspended from a lower spacer.

A golf club caddy 10 of the present invention is shown in assembled condition in FIGS. 1–6. The golf club caddy 10 is formed by a pair of standards 12 and 14, each of which have a ground-supporting member 16 fixed to a lower end 18 of each standard. The standards 12, 14 can be made of a strong, light-weight tubing such as anodized aluminum. A lower end 20 of each ground-supporting member 16 can include a protective cap 22 covering a tapered point 24 (shown in FIG. 6). The upper end 26 of each standard 12 includes a molded plastic cap 28, primarily for esthetic reasons, although the cap 28 can act to exclude rain from the interior of the standard 12.

A plurality of U-shaped engagement members 30 are fixed to first and second opposite surfaces 32 and 34 of each standard. While the Figures of the present illustrate there to be two engagement members 30 on surface 32 and three engagement members 30 on surface 34, the actual number is substantially merely a choice of design. The only restriction on the number of engagement members 30 relates to the size of the club heads on the clubs expected to be carried on the caddy 10, since it is generally undesirable for the clubs to make significant contact with other clubs, which might easily occur if the engagement members 30 are too closely spaced.

FIG. 6 illustrates one particular arrangement that can be achieved using a golf club caddy 10 of the present invention. It will be appreciated that a golf club caddy 10 of the present invention is generally intended for use only with an abbreviated set of clubs 8 shown in phantom. The U-shaped engagement members 30 are preferable formed of adhered reclaimed or recycled rubber. One convenient source for material having the most desirable properties is a reclaimed rubber material sold by Centaur Floor Systems, LLC, located in Santa Barbara, Calif. under the trademark Rubberflex Tuf-tile. The use of such reclaimed rubber material to form the engagement members 30 is not only resource friendly, but had the advantage of being able to firmly grip the club shaft 6 without any danger of damaging the club shaft. The U-shaped engagement members 30 have one side bonded to the standards 12,14 using an adhesive. A particularly satisfactory adhesive is sold by Eclectic Products, Inc., of Pineville, La., under the brand name GOOP Sportsman adhesive. The gripping engagement members 30 include an inverted key-hole shaped slot 29 with a tapered opening portion 31 to the slot 29 to allow for easy placement and withdrawal of the clubs, yet insuring retention of the clubs during handling of the caddy.

Figure 7:
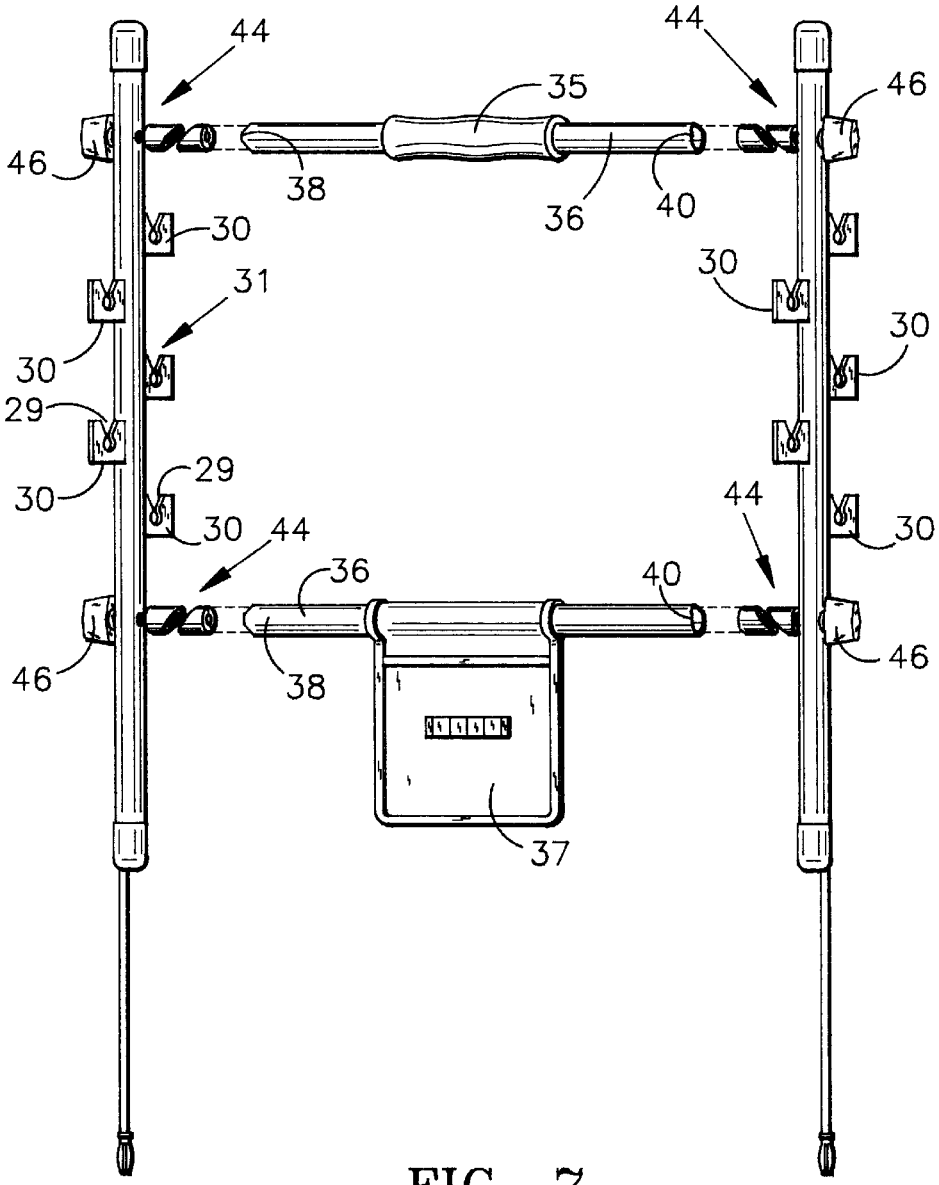
FIG. 7 is an exploded perspective view of the golf club caddy shown in FIG. 6 from the back side.

A set of spacing members 36 are positioned between the pair of standards 12 and 14. Each spacing member 36 has ends 38 and 40 contacting an inner surface 42 of the standards 12 and 14. Releasable coupling members 44 extend into the spacing member ends 38 and 40 from each standard 12 and 14. Each of the releasable coupling members 44 include a handle 46 to facilitate manual release of the coupling member 44 so that the standards 12, 14 and spacing members 36 can be quickly disassembled for storage as well as reassembled subsequent to storage. A grip portion 35 is centrally located between the ends of the top spacing member 36 to provide a comfortable and balanced grip for carrying the caddy 10. As shown in FIGS. 6 and 7, another spacing member 36 can receive a ball and tee pouch 37 which can be slidably removed and replaced with other more desirable or suitable storage pouches or brackets for related equipment. Other additions can be conveniently suspended from the spacing members as desired, and easily removed or omitted from any subsequent re-assembly of the caddy to allow the user to configure the assembled caddy to fit the particular needs of the individual golfer.

Figure 8:
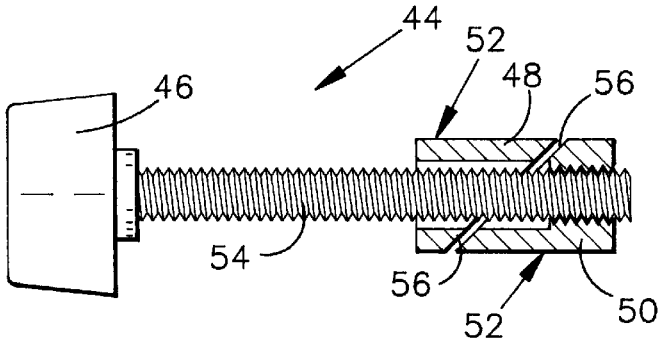
FIG. 8 is a detail view partially in section of a coupling member including a handle shown used in the previous Figures.

The coupling members 44 of the present invention are best illustrated in FIGS. 7 and 8 to include a proximal wedge member 48 and a distal wedge member 50. Both wedge members 48 and 50 are received into the ends 38 and 40 of the spacing members 36 as shown in FIG. 7. Both wedge members 48 and 50 have an outer surface 52 sized to be received within, yet engage an inner surface of, the spacing members 36. Each coupling member 44 also includes a threaded member 54 fixed to the handle 46 of the releasable coupling member. The threaded member 54 extends through both wedge members 48 and 50. Each wedge member includes a tapered edge 56, the tapered edges 56 of the two wedge members 48 and 50 confronting, and being slidably engaged with, each other. The proximal wedge member 48 is preferably slidably arranged with respect to the threaded member 54 while the distal wedge member 50 is engaged on the threaded member 54 so that rotation of the handle member 46 causes displacement of the distal wedge member 50 with respect to the spacing member 36.

Figure 9:
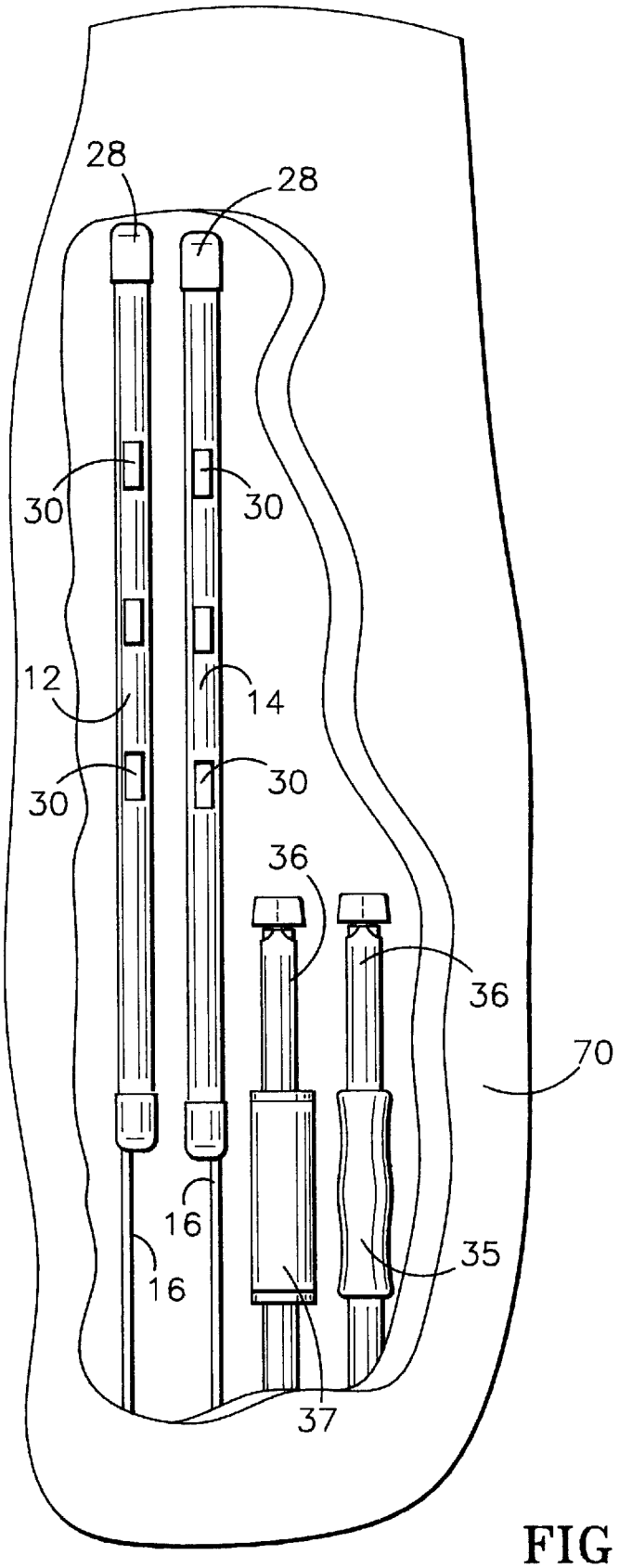
FIG. 9 a schematic view of a golf club caddy of the present invention is a disassembled condition situated in a carrier.

That is, rotation of the handle member 46 in one direction will draw the distal wedge member 50 toward the proximal wedge member 48, and thus cause a lateral displacement of the proximal wedge member 48 against the interior surface of the spacing member 36. Rotation of the handle member 46 in the opposite direction will displace the distal wedge member 50 away from the proximal wedge member 48, thus allowing the proximal wedge member 48 to become disengaged from secure contact with the interior surface of the spacing member 36, and thereby allowing the wedge members 48 and 50 to be pulled out of the end 38 or 40 of the spacing member 36. In this manner the fully assembled golf club caddy 10 of the present invention, as shown in FIGS. 1–6 can quickly and easily disassembled to the state shown in FIG. 7 with just the manual turning of the four handles 46 about one full turn, or so. Easy and convenient storage of the spacing members 36 and the standards 12 and 14 in a compact form can be into a convenient bag or pouch 70, schematically shown in FIG. 9, which can be a portion of a standard, full sized golf bag.

Figure 11:
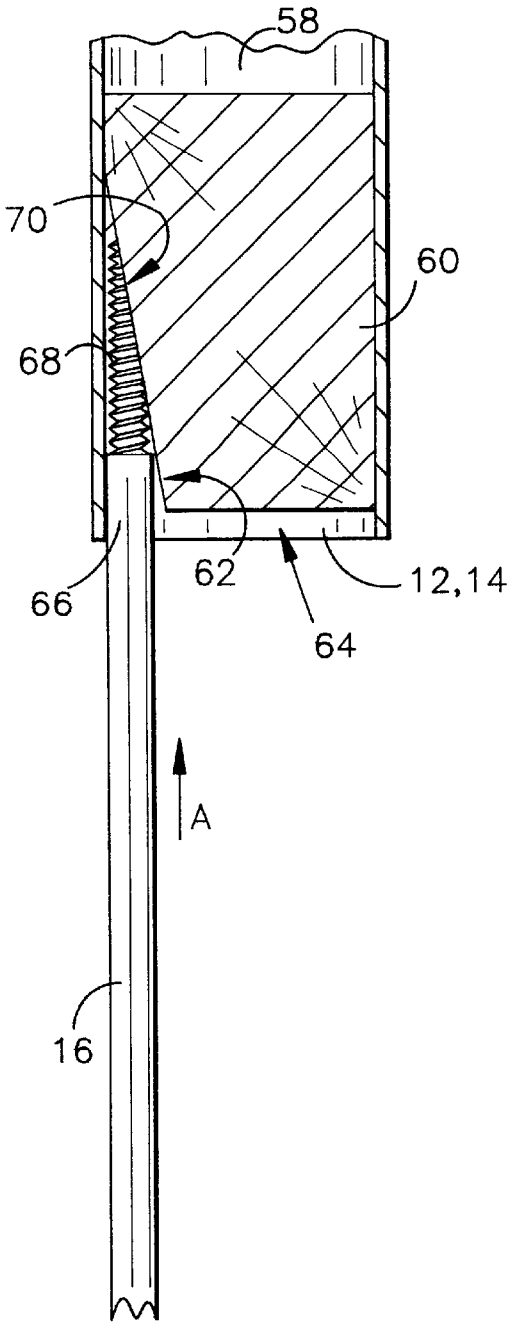
FIG. 11 is a view similar to FIG. 10 showing the pre-assembly relationship of the ground support member and block.
Figure 10:
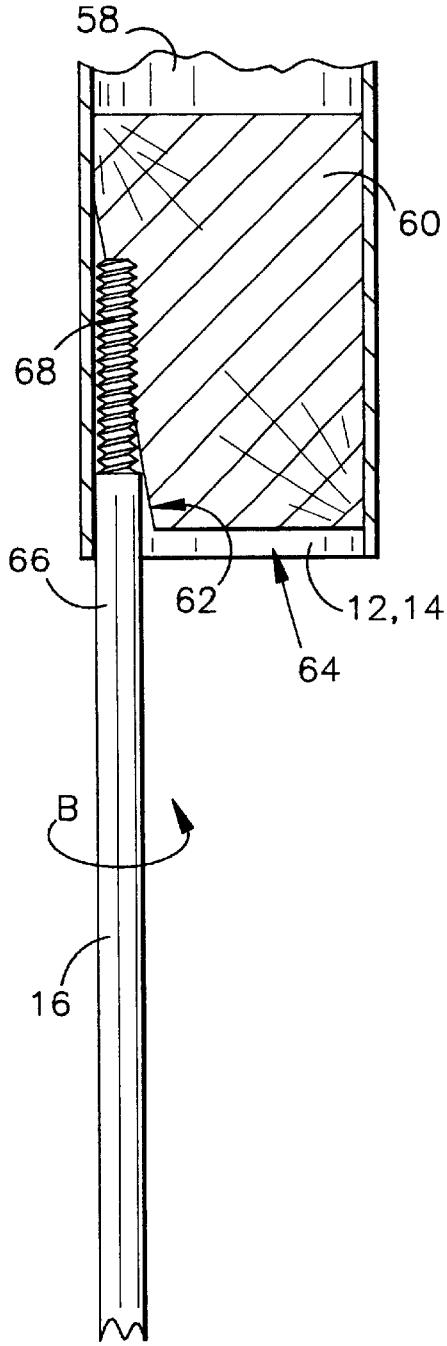
FIG. 10 is a sectional detail view of a ground support member and block received in a lower end of a standard forming a golf club caddy of the present invention.

As is shown in FIG. 10, each of the pair of standards 12, 14 is formed by a tubular member 58 that includes a block 60, preferably made of oak or other hardwood, positioned in the lower end 18 of the tubular member 58. Each block 60 includes a side face 62 that is spaced from the interior surface 64 of the tubular member 58 forming the standard 12, 14. The side face 62 can be inclined as shown in FIGS. 10 and 11, or can be parallel to the interior surface 64 of the tubular member 58. Each of the ground supporting members 16 comprises an elongated stake, preferably formed of hardened steel similar to that used in timber spikes having a sharpened lower end 24, shown in FIG. 6, for penetrating the ground, and an upper end 66 having a threaded portion 68 engaged in the block 60 as shown in FIG. 10. Preferably, the upper end 66 of each stake 16 includes a smooth face 70 adapting the elongated stake to be slidably received in direction A between the side face 62 of the block 60 and the interior surface 64 of the tubular member 58, as shown in FIG. 11. The smooth face 70 on stake 16 is preferably configured to reflect the face 62 on block 60, so that if face 62 is parallel to interior surface 64, then face 70 on stake 16 would generally reflect this conformation. In either case, the threaded portion 68 of the stake 16 will become engaged in the block 60 and the interior surface of 64 of the tubular member 58 upon rotation of the stake 16 in direction B relative to the standard 12, 14 to the position shown in FIG. 10.

The present invention has been described with particular reference to the illustrated preferred embodiment to enable those skilled in the art to understand and practice the present without undue experimentation. It will be appreciated, however, that other variations of the present invention are possible that are intended to be within the scope of the following claims.

What is claimed is:

1. A golf club caddy comprising: a pair of standards, a ground supporting member fixed to a lower end of each standard, a plurality of U-shaped engagement members fixed to first and second opposite faces of each standard, releasable coupling members extending from a side of each standard, each releasable coupling member including a handle for manual release of the coupling member, spacing members adapted to be positioned between the pair of standards, each spacing member having ends for releasable engagement with one of the releasable coupling members.

2. The golf club caddy of claim 1 wherein each of the pair of standards comprises a tubular member and each ground supporting member comprises an elongated stake having a sharpened lower end for penetrating the ground.

3. The golf club caddy of claim 2 wherein the lower end of each standard includes a block and each elongated stake includes an upper end having a threaded portion engaged in the block.

4. The golf club caddy of claim 3 wherein each block includes a side face spaced from an interior surface of the tubular member forming the standard, and the upper end of each stake includes a smooth face adapting the elongated stake to be slidably received between the side face of the block and the interior surface of the tubular member prior to engagement by rotation of the stake relative to the standard.

5. The golf club caddy of claim 1 wherein each U-shaped engagement member comprises a flexible rubber gripping member having one side bonded to the standard, the gripping member including an inverted key-hole shaped slot with a tapered opening portion to the slot.

6. The golf club caddy of claim 1 wherein each of the coupling members includes a proximal and a distal wedge member, both wedge members having an outer surface sized to be received into the ends of the spacing members, each coupling member also including a threaded member fixed to the handle and extending through both wedge members.

7. The golf club caddy of claim 6 wherein each wedge member includes a tapered edge, the tapered edges of the two wedge members of each coupling member being slidably engaged with each other, the proximal wedge member being slidably arranged with respect to the threaded member, and the distal wedge member being engaged by the threaded member.

8. The golf club caddy of claim 1 wherein one of the spacing members includes a grip portion centrally located between the ends thereof for providing a comfortable grip for carrying the caddy.

9. The golf club caddy of claim 1 further comprising a pouch for carrying the standards and spacing members in uncoupled fashion.

10. The golf club caddy of claim 1 further comprising a ball and tee pouch slidably received on one of the spacing members.

11. A golf club caddy comprising: a pair of standards, a ground supporting member fixed to a lower end of each standard, a plurality of U-shaped engagement members fixed to first and second opposite faces of each standard, spacing members positioned between the pair of standards, each spacing member having ends contacting an inner surface of the standards, releasable coupling members extending into the spacing members from each standard, a handle connected to each releasable coupling member for manual release of the coupling member so that the standards and spacing members can be quickly disassembled for storage as well as reassembled subsequent to storage.

12. The golf club caddy of claim 11 wherein each of the coupling members includes a proximal and a distal wedge member, both wedge members being received into the ends of the spacing members and having an outer surface sized to engage an inner surface of the spacing members, each coupling member also including a threaded member fixed to the handle and extending through both wedge members.

13. The golf club caddy of claim 12 wherein each wedge member includes a tapered edge, the tapered edges of the two wedge members of each coupling member being slidably engaged with each other, the proximal wedge being slidably arranged with respect to the threaded member, and the distal wedge member being engaged by the threaded member so that rotation of the handle member causes displacement of the distal wedge member with respect to the spacing member.

14. The golf club caddy of claim 11 wherein each of the pair of standards comprises a tubular member including a block and each ground supporting member comprises an elongated stake having a sharpened lower end for penetrating the ground and an upper end having a threaded portion engaged in the block.

15. The golf club caddy of claim 14 wherein each block includes a side face spaced from an interior surface of the tubular member forming the standard, and the upper end of each stake includes a smooth face adapting the elongated stake to be slidably received between the side face of the block and the interior surface of the tubular member prior to engagement by rotation of the stake relative to the standard.

16. The golf club caddy of claim 11 wherein each U-shaped engagement member comprises a flexible gripping member formed of adhered reclaimed rubber having one side bonded to the standard, the gripping member including an inverted key-hole shaped slot with a tapered opening portion to the slot.

17. The golf club caddy of claim 11 further comprising a grip portion centrally located between the ends of one of the spacing members for providing a comfortable grip for carrying the caddy, and a ball and tee pouch slidably received on another one of the spacing members.

18. The golf club caddy of claim 1 further comprising a pouch for carrying the standards and spacing members in uncoupled fashion.

19. A golf club caddy comprising:

a pair of standards, each of the standards having a ground supporting member fixed to a lower end of the standard, a plurality of U-shaped engagement members fixed to first and second opposite faces of each standard, spacing members positioned between the pair of standards, each spacing member having ends contacting an inner surface of the standards, a grip portion centrally located between the ends of an uppermost of the spacing members for providing a comfortable grip for carrying the caddy, releasable coupling members extending into the spacing members from each standard, each of the coupling members includes a proximal and a distal wedge member, both wedge members being received into the ends of the spacing members and having an outer surface sized to engage an inner surface of the spacing members, wherein each wedge member includes a tapered edge, the tapered edges of the two wedge members of each coupling member being slidably engaged with each other, each coupling member also including a threaded member extending through the wedge members, the proximal wedge being slidably arranged with respect to the threaded member, and the distal wedge member being engaged by the threaded member, a handle connected to each threaded member so that rotation of the handle member causes displacement of the distal wedge member with respect to the spacing member for manual release of the coupling member so that the standards and spacing members can be quickly disassembled for storage as well as reassembled subsequent to storage.

20. The golf club caddy of claim 19 wherein each of the pair of standards comprises a tubular member including a block having a side face spaced from an interior surface of the tubular member forming the standard, and each ground supporting member comprises an elongated stake having a sharpened lower end for penetrating the ground and an upper end having a threaded portion engaged in the block, the upper end of each stake also including a smooth face adapting the elongated stake to be slidably received between the side face of the block and the interior surface of the tubular member prior to engagement by rotation of the stake relative to the standard.

* * * * *